US007793594B2

(12) United States Patent
Lerchenmueller

(10) Patent No.: US 7,793,594 B2
(45) Date of Patent: Sep. 14, 2010

(54) CRANE

(75) Inventor: Peter Lerchenmueller, Hard (AT)

(73) Assignee: Hans Kuenz Gesellschaft M.B.H., Hard (AT)

( * ) Notice: Subject to any disclaimer, the term of this patent is extended or adjusted under 35 U.S.C. 154(b) by 296 days.

(21) Appl. No.: 11/869,108

(22) Filed: Oct. 9, 2007

(65) Prior Publication Data

US 2008/0083688 A1 Apr. 10, 2008

(30) Foreign Application Priority Data

Oct. 9, 2006 (DE) ..... 10 2006 047 997

(51) Int. Cl.
*B61D 1/00* (2006.01)

(52) U.S. Cl. ..... 105/163.1; 105/165; 105/166; 105/167; 296/190.05

(58) Field of Classification Search ..... 105/163.1, 105/165, 166, 167; 296/190.05; 180/89.13
See application file for complete search history.

(56) References Cited

U.S. PATENT DOCUMENTS 3,408,950 A * 11/1968 Puhringer ..... 104/141
3,450,062 A * 6/1969 Pradon ..... 105/177
3,640,503 A * 2/1972 Spannlang ..... 254/84
3,877,391 A * 4/1975 Gimperlein et al. ..... 105/163.1
4,188,887 A * 2/1980 Dewing et al. ..... 105/163.1
4,226,332 A * 10/1980 McCaffrey ..... 212/324
4,875,415 A * 10/1989 Kasugai ..... 104/35
5,076,450 A * 12/1991 Shimizu ..... 212/324

(Continued)

FOREIGN PATENT DOCUMENTS

DE 619 805 10/1935

(Continued)

*Primary Examiner*—S. Joseph Morano
*Assistant Examiner*—Jason C Smith
(74) *Attorney, Agent, or Firm*—Frommer Lawrence & Haug LLP

(57) ABSTRACT

The invention is directed to a crane which comprises a traveling gear which comprises a plurality of traveling gear groups for moving along rails, each traveling gear group having at least two wheels which are rotatably mounted at a subframe so as to be spaced apart in longitudinal direction of the respective rail and are connected to an end carriage by a central joint having at least degrees of freedom for rotating the traveling gear group relative to the end carriage around a vertical axis and for swiveling the traveling gear group relative to the end carriage around a horizontal axis extending at right angles to the rails. According to the invention, the central joint is constructed in vertical direction as a floating bearing so that only horizontal forces can be transmitted by this central joint, and a respective traveling gear group is further connected to a respective end carriage by two connecting rods which are arranged on opposite sides of the central joint viewed in transverse direction of the respective rail and which are connected to the traveling gear group on one side and to the end carriage on the other side by joints lying one above the other, which joints can transmit compressive forces as well as tensile forces and which have at least degrees of freedom for swiveling the connecting rods relative to the traveling gear group and relative to the end carriage, respectively, around a horizontal axis extending at right angles to the respective rail and around a horizontal axis extending parallel to the respective rail.

9 Claims, 6 Drawing Sheets

U.S. PATENT DOCUMENTS

| | | | | |
|---|---|---|---|---|
| 6,367,390 | B1 * | 4/2002 | Okubo et al. | 105/163.1 |
| 6,382,865 | B1 * | 5/2002 | Paxman | 403/131 |
| 2002/0046677 | A1 * | 4/2002 | Okubo et al. | 105/163.1 |
| 2008/0083688 | A1 * | 4/2008 | Lerchenmueller | 212/312 |

FOREIGN PATENT DOCUMENTS

| | | |
|---|---|---|
| DE | 38 28 249 | 2/1990 |
| DE | 37 21 244 | 11/1993 |
| DE | 3704704 | 9/1998 |
| DE | 19943098 | 4/2001 |
| DE | 199 43 098 | 10/2003 |
| NL | 6604798 | 10/1996 |

* cited by examiner

Fig. 1
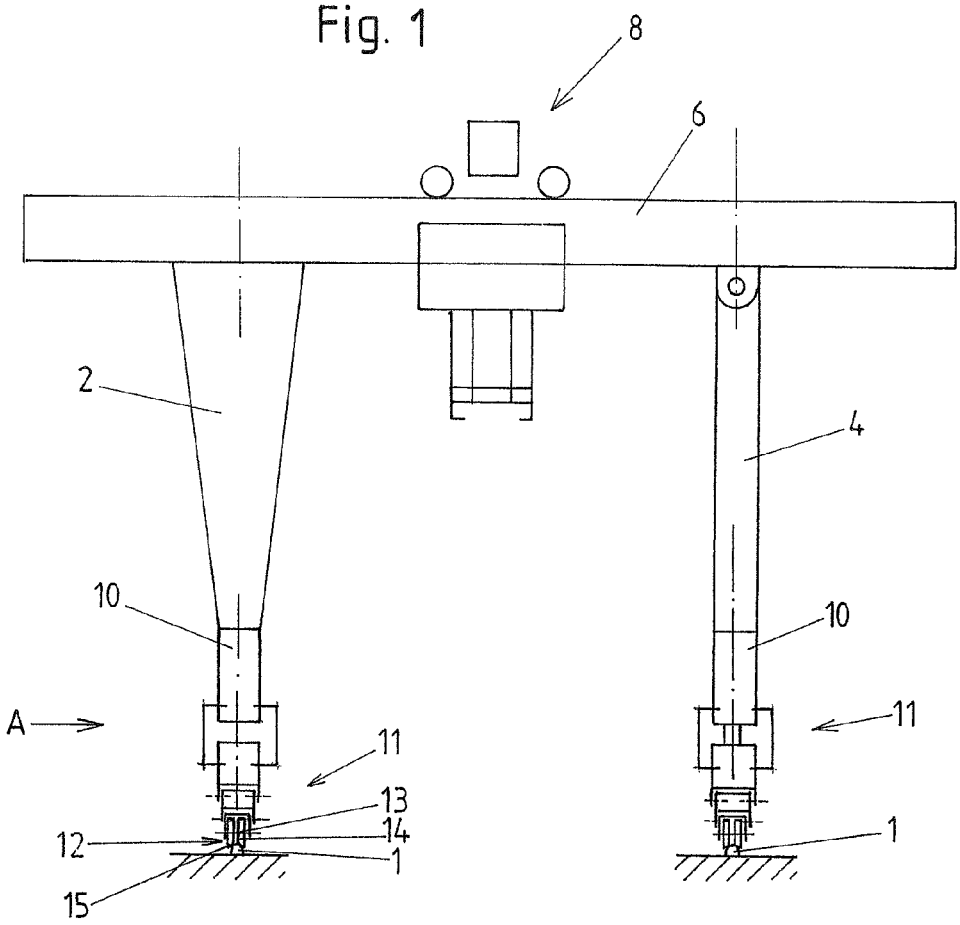
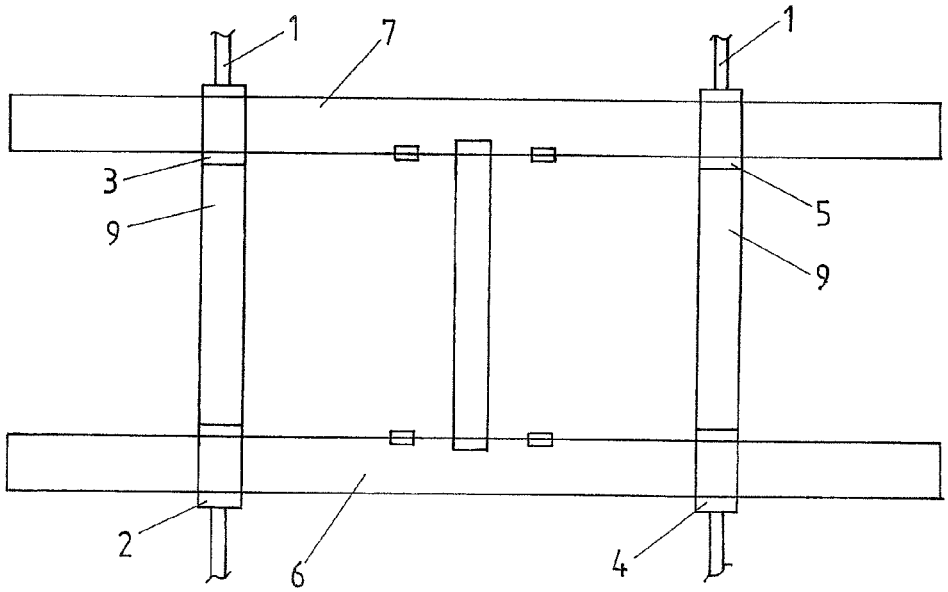
Fig. 2

CRANE

CROSS-REFERENCE TO RELATED APPLICATION

This application claims priority of German Application No. 10 2006 047 997.1, filed Oct. 9, 2007, the complete disclosure of which is hereby incorporated by reference.

BACKGROUND OF THE INVENTION a) Field of the Invention

The invention is directed to a crane comprising a traveling gear for moving along rails which has a plurality of traveling gear groups, each having at least two wheels which are rotatably mounted at a subframe so as to be spaced apart from one another in longitudinal direction of the respective rail and which are connected to an end carriage of the crane by a central joint having at least degrees of freedom for rotating the traveling gear group relative to the end carriage around a vertical axis and for swiveling the traveling gear group relative to the end carriage around a horizontal axis extending right angles to the rails.

b) Description of the Related Art

Traveling gear of rail-bound cranes, particularly gantry cranes or bridge cranes, comprise at least two traveling gear groups, each of which has at least one wheel for moving the crane and each of which individually or all of which are outfitted with at least one driving motor for moving the crane. For example, a traveling gear group is arranged on all four legs of a gantry crane.

An exact orientation of the axles of the wheels relative to the rails is essential for low wear, above all in heavy cranes whose traveling gear groups have two or more wheels. The traveling gears themselves can be produced with very high accuracy as regards the axle positions and the position of the track guiding means. The traveling gear groups can be measured in the assembled state. In practice, measurement results are usually far below the positional tolerances predetermined by the relevant standards and practices.

In a conventional embodiment form of a crane whose traveling gear groups each have at least two or more wheels which are spaced apart from one another in longitudinal direction of the respective rail, the individual traveling gear groups are connected to an end carriage of the steel construction of the crane with only one degree of freedom, namely a swiveling around a horizontal axis extending transverse to the rails. In this case, the bore holes in the end carriage which receive the swiveling axle of the respective traveling gear group must be very precise, particularly with respect to the axial position transverse to the runway. These bore holes constitute interfaces between the mechanical construction of the traveling gear group and the steel construction of the crane frame, which has often proven problematic in practice. An inclined position of the axles can be brought about, for example, by sunlight which heats the end carriage in an uneven manner so that the axle positions change. Also, horizontal forces caused by skewed running, wind forces, and inertial forces are absorbed by only by a certain quantity of wheels. Accordingly, in traveling gears of this kind having multiple wheels, the horizontal forces that must also be absorbed by the rail construction are disadvantageously large. The occurring axial deviations and the unfavorable distribution of horizontal forces lead to bending in the traveling gear and, accordingly, to increased wear on the track guiding means, the wheel running surfaces, and the rails.

Constructions for reducing wear are already known, wherein an additional degree of freedom is provided for the articulation of the traveling gear group at the end carriage, namely, rotatablity around a vertical axis. Accordingly, the traveling gears are free from bending relative to the stiff, imprecise steel construction of the crane, for example, a gantry crane. External forces due to differences in temperature and deformations no longer affect the running geometry. Horizontal forces are transmitted to the rails by practically all of the track guiding means. The oblique running behavior is substantially improved or oblique running can be ruled out in cranes with synchronized running devices.

Different constructions are already known for forming the connection between the traveling gear group and the end carriage with an additional rotatability around a vertical axis.

A construction using a live ring with balls or rollers is unobjectionable in technical respects but has a very large structural width and is very disadvantageous in terms of cost. The use of a sliding bearing support with an additional counter-support for absorbing tilting forces, also already known, has the disadvantage that very high rotational resistances must be overcome. The bearing forces can be 150 t or more, for example. Because of the high tilting forces, particularly when the corners of the crane are not loaded, very expensive counter-supports are provided in addition.

Further, it is known for this purpose to install an axial ball bearing with additional counterbearings. In this case, it is necessary to pretension the main bearing with very high pretensioning forces over the counterbearing until one-sided lifting of the main bearing is no longer possible. If the main bearing is lifted only slightly, the entire vertical force is shifted to one or a few rolling bodies which would lead to the destruction of the bearing. Disadvantages in this construction include the risk of a change in pretensioning forces, e.g., due to settling over the course of crane operation, loading of the balls and of the runway, which practically always occurs at the same point due to the very slight movement of the bearing, and the expensive construction.

In another known construction, a central joint in the form of a spherical pressure bearing which absorbs the bearing force is provided for connecting the traveling gear group to the end carriage. The tilting forces resulting from the horizontal forces transverse to the rail are absorbed by tension rods which are arranged at both sides of the central joint between the end carriage and the traveling gear group. One of the disadvantages is this case is that high bearing forces result from the tilting moment because the tension rods can only absorb tensile forces.

OBJECT AND SUMMARY OF THE INVENTION

It is the primary object of the invention to provide a connection of the traveling gear groups of the crane traveling gear to the end carriage by means of an economical design accompanied by advantageous transmission of force.

According to the invention, this object is met by a crane comprising a traveling gear for moving the crane along rails having a plurality of traveling gear groups, each having at least two wheels which are rotatably mounted at a subframe so as to be spaced apart in longitudinal direction of the respective rail, and at least one end carriage, wherein a respective traveling gear group is connected to a respective end carriage by a central joint having at least degrees of freedom for rotating the traveling gear group relative to the end carriage around a vertical axis and for swiveling the traveling gear group relative to the end carriage around a horizontal axis extending at right angles to the rails and is constructed in vertical direction as a floating bearing so that only horizontal forces can be transmitted by this central joint, and a respective traveling gear group is further connected to a respective end carriage by two connecting rods which are arranged on opposite sides of the central joint viewed in transverse direction of the respective rail and which are connected to the traveling gear group on one side and to the end carriage on the other side by joints lying one above the other, which joints can transmit compressive forces as well as tensile forces and which have at least degrees of freedom for swiveling the connecting rods relative to the traveling gear group and relative to the end carriage, respectively, around a horizontal axis extending at right angles to the respective rail and around a horizontal axis extending parallel to the respective rail.

According to the invention, the central joint is constructed in vertical direction as a floating bearing, i.e., no vertical forces are transmitted by it. Vertical compressive and tensile forces are accordingly transmitted exclusively by the two connecting rods which are connected to the traveling gear group on one side and to the end carriage on the other side by joints lying one above the other. These joints are preferably constructed as spherical joints. Since the mobility with respect to the axis oriented parallel to the rail need only be very slight, it would also be conceivable and possible, for example, for the degree of freedom with respect to this axis extending parallel to the rail to be formed by a corresponding play of a rolling bearing or sliding bearing which is swivelable around an axis extending at right angles to the rail.

In a preferred embodiment form of the invention, the central joint is formed as a spherical joint. It would also be conceivable and possible in principle to form the central joint by a first partial joint having only one degree of freedom for swiveling around an axis extending at right angles to the rail and by a second partial joint having only one degree of freedom for swiveling around a vertical axis.

A crane according to the invention can be constructed, for example, as a gantry crane. It would also be conceivable and possible to construct it, for example, as a bridge crane.

Further advantages and details of the invention are described in the following with reference to the accompanying drawings which also show further objects of the invention.

BRIEF DESCRIPTION OF THE DRAWINGS

FIGS. 1 and 2 show a front view and top view of a crane according to the invention in a highly schematic and simplified manner;

DESCRIPTION OF THE PREFERRED EMBODIMENT EXAMPLES

Figure 3:
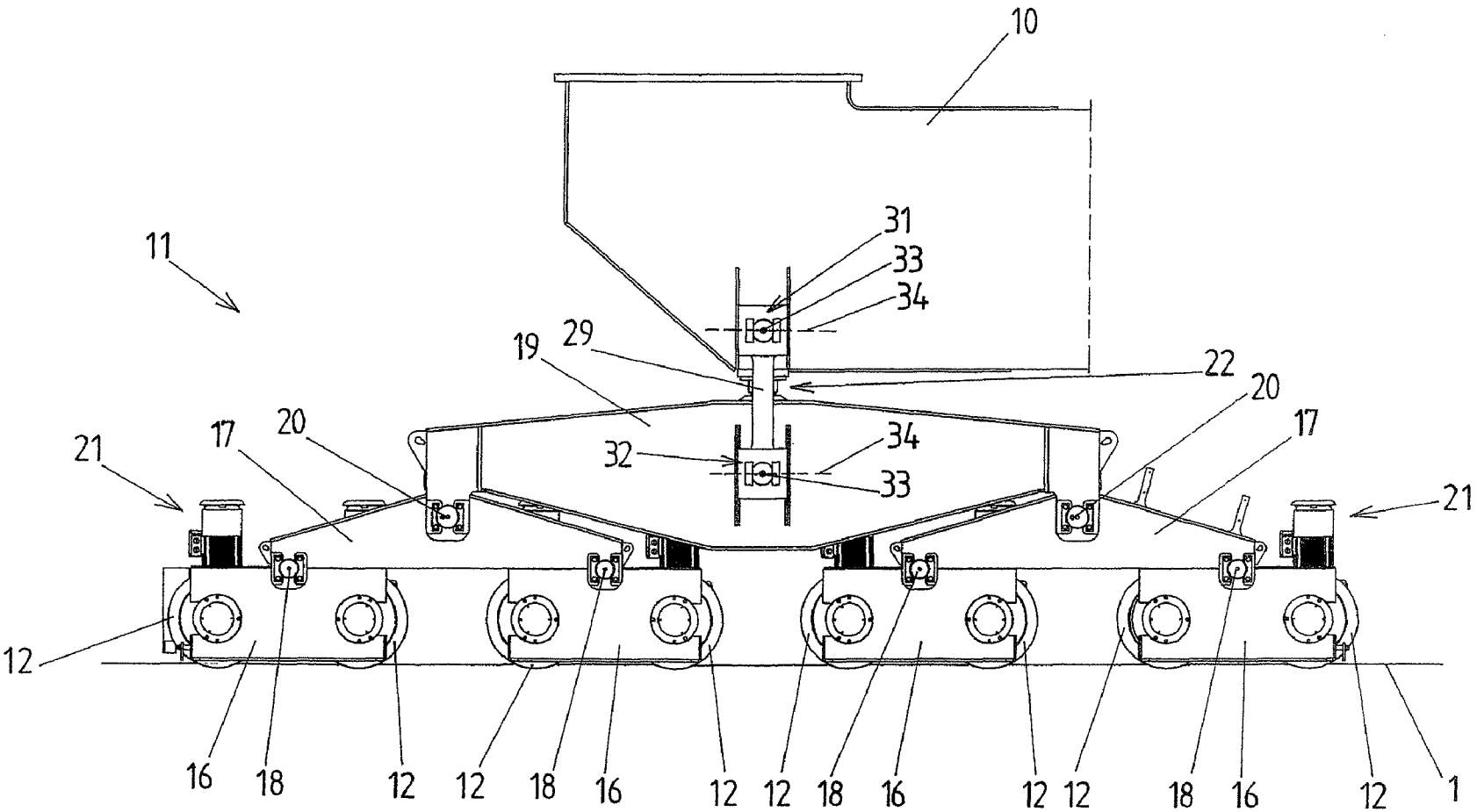
FIG. 3 shows a side view (viewing direction A in FIG. 1) of a traveling gear group connected to an end carriage.
Figure 4:
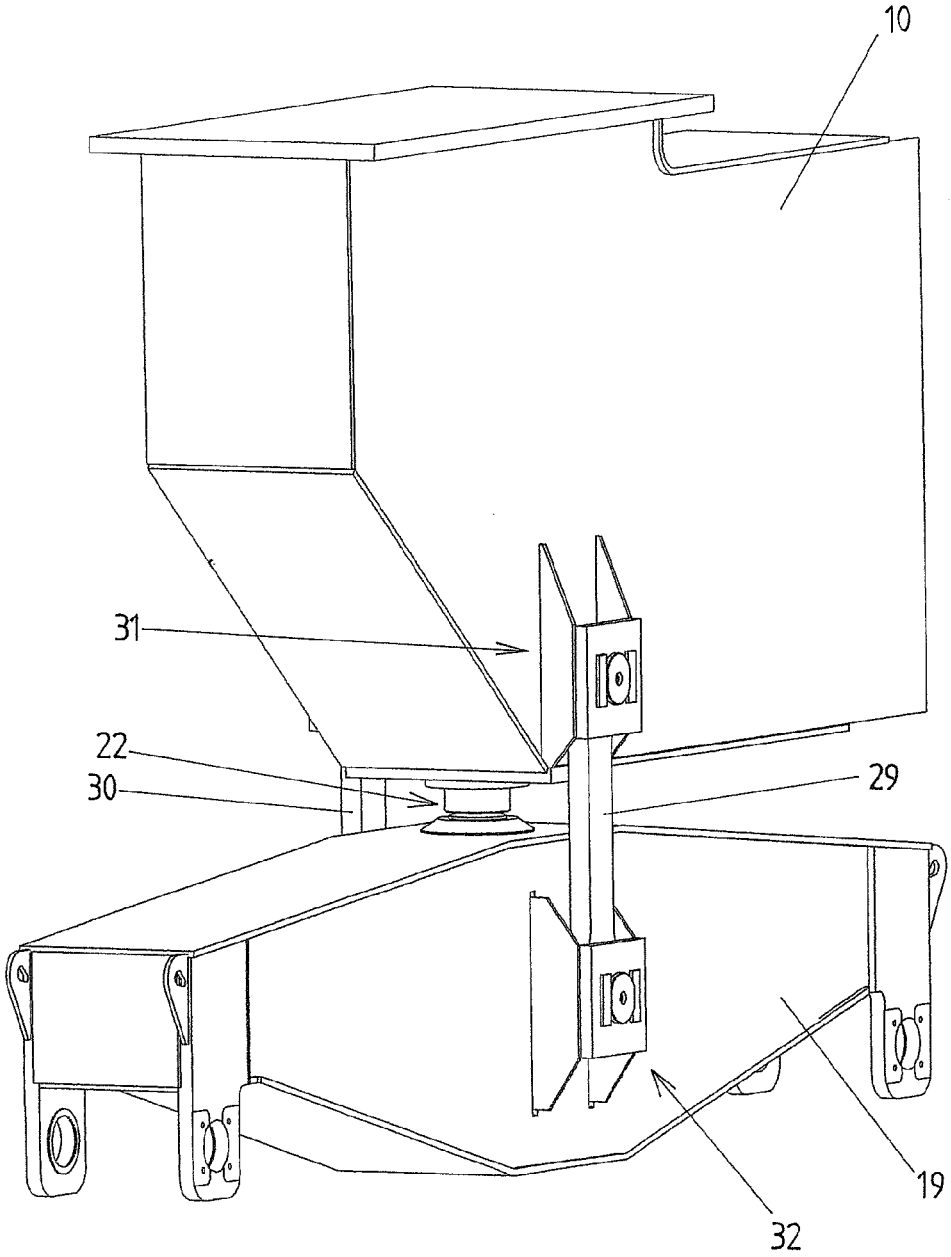
FIG. 4 shows an oblique view of the upper rocker of the traveling gear group connected to the end carriage.
Figure 5:
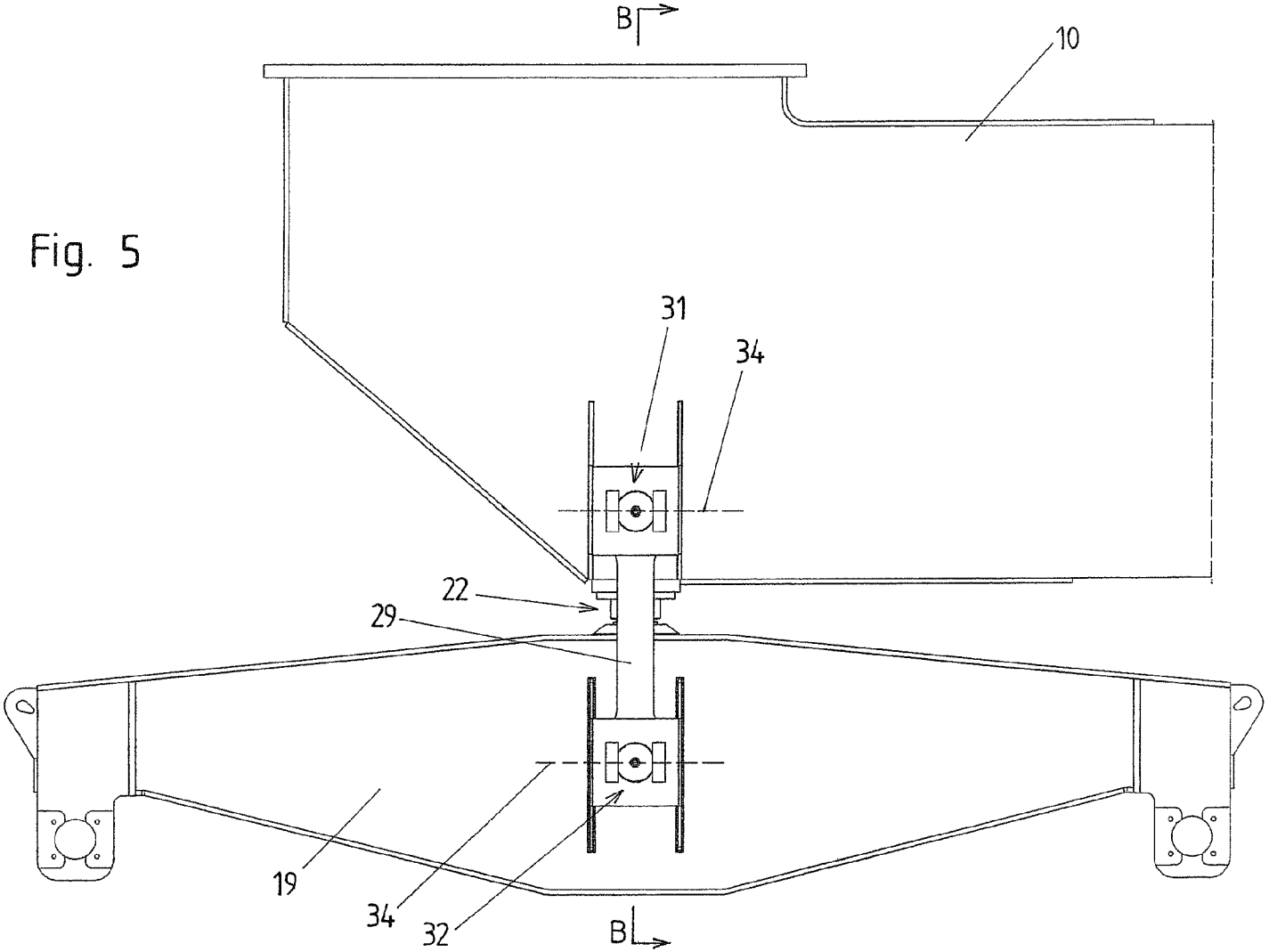
FIG. 5 shows a side view of the parts from FIG. 4.
Figure 6:
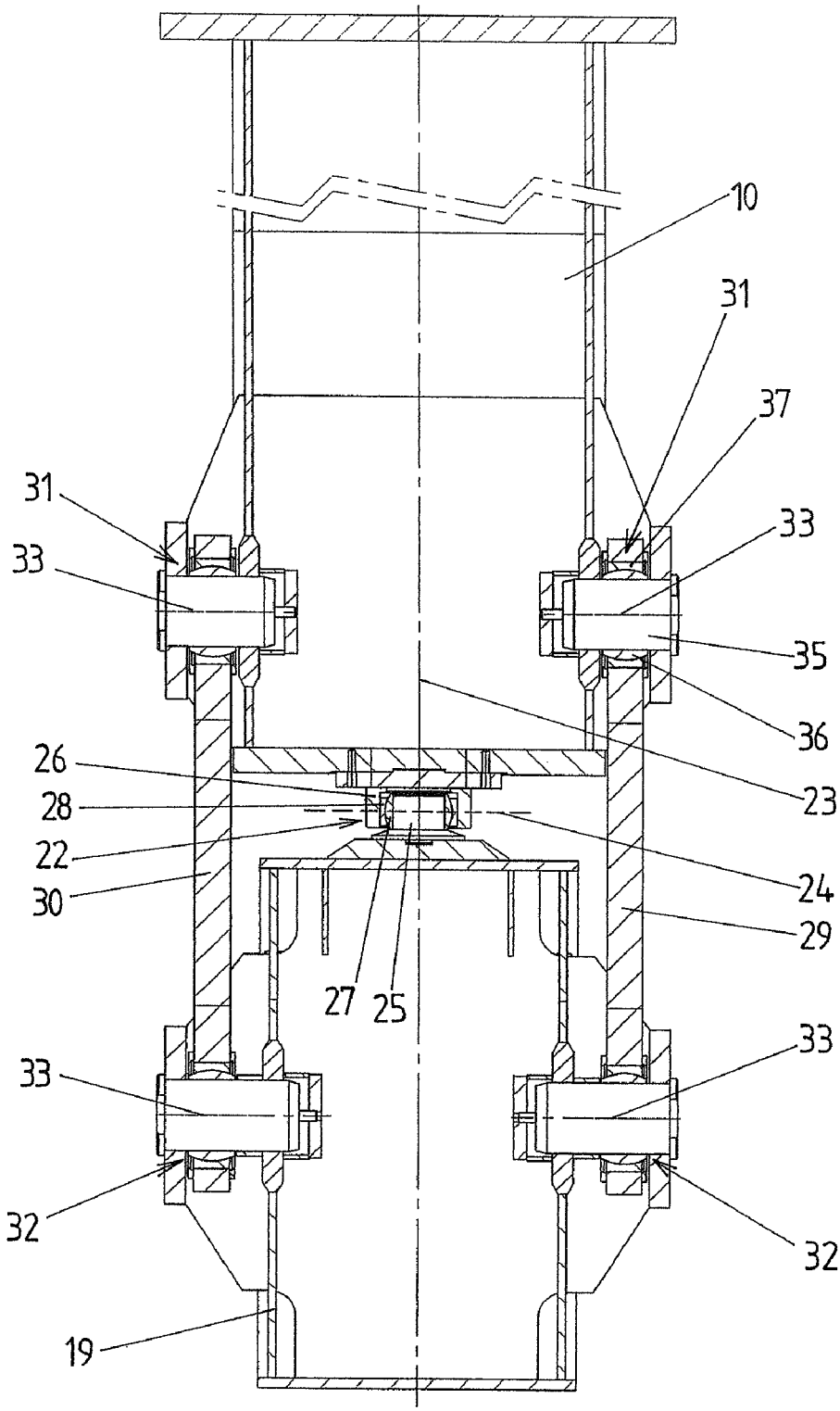
FIG. 6 shows a section along line B-B of FIG. 5.

An embodiment example of the invention is shown in the drawings. The crane is constructed as a gantry crane which can move on a runway formed by two rails 1 laid at a distance from one another. A gantry crane of this kind usually has four legs 2, 3, 4, 5. Constructions with three legs are also known. Further, two supports can also be provided. The legs 2-5 and supports carry the transverse girder or transverse girders 6, 7 along which a trolley 8 is movable or which are provided with another type of movable or fixed hoisting device. When the construction is carried out with two or more transverse girders 6, 7, connection girders 9 extend between the latter.

An end carriage 10 is arranged at the lower ends of the legs 2, 3; 4, 5 arranged on a respective side of the gantry and connects them. The end carriages 10 serve to connect the steel construction of the crane to the individual traveling gear groups 11 of the crane traveling gear. A traveling gear group I of this kind is arranged below each of the legs 2-5.

It would also be conceivable and possible in principle, for example, to provide each leg 2-5 with its own end carriage 10. For each rail 1, there are preferably at least two traveling gear groups 11 at a distance from one another in longitudinal direction of the rail 1. An arrangement below a respective leg 2-5 is preferred.

In the present embodiment example, a respective traveling gear group 11 has eight wheels 12 at a distance from one another in longitudinal direction of the rails 1. The axles 13 of the wheels 12 are oriented at right angles to the rails 1. A respective wheel 12 can have two wheel flanges 14, 15 connected by an axle 13 at a distance from one another in transverse direction of the rail 1, as is shown schematically in FIG. 1.

Two wheels 12 which are situated one behind the other in longitudinal direction of the rails are rotatably mounted in each instance at a subframe 16. In the present embodiment example, there are four subframes 16 per traveling gear group which lie one behind the other in longitudinal direction of the rails.

Two subframes 16 located one behind the other in longitudinal direction of the rails are connected to a common rocker 17. Accordingly, in the present embodiment example there are two rockers 17 at a distance from one another in longitudinal direction of the rails 1. The subframes 16 are connected to the rockers 17 so as to be swivelable around horizontal axes 18 extending at right angles to the rails.

The two rockers 17 are connected to a common rocker 19, and they are swivelable relative to the rocker 19 around a horizontal axis 20 extending at right angles to the rail 1.

Driving motors 21 which drive the respective wheels 12 serve to move the crane along the rails 1. The quantity of these driving motors 21 can vary depending on the application.

The respective end carriage 10 is connected to the respective traveling gear group 11 in such a way that the traveling gear group 11 is swivelable relative to the end carriage 10 around a horizontal axis extending at right angles to the respective rail 1 and is rotatable around a vertical axis. A connection device having a central joint 22 is provided for this purpose. This central joint 22 has at least the following degrees of freedom: a degree of freedom for rotating the traveling gear group 11 relative to the end carriage 10 around a vertical axis 23 and a degree of freedom for swiveling the traveling gear group 11 relative to the end carriage 10 around a horizontal axis 24 extending transverse to, particularly at right angles to, the respective rail 1.

In the present embodiment example, these degrees of freedom are formed by the construction of the central joint 22 in the form of a spherical joint or ball joint. In this case, the central joint 22 comprises a bearing pin 25 which is connected to the rocker 19, a bearing bush 26 connected to the end carriage 10, an inner race 27 which is arranged on the bearing pin 25 and has a spherical or spherical-segment-shaped outer surface, and an outer race 28 which is arranged in the bearing bush 26 and has a spherical or spherical-segment-shaped inner surface that cooperates with the spherical outer surface of the inner race 27. The joint could also be arranged "in reverse", that is, the bearing pin 25 could be connected to the end carriage 10 and the bearing bush 26 could be connected to the rocker 19.

The central joint 22 is constructed as a floating bearing in vertical direction, i.e., it has play in this direction in the assembled state. Accordingly, this central joint 22 does not transmit any vertical forces. On the other hand, forces acting in horizontal direction are transmitted, namely, in direction of the respective rail 1 and at right angles to the latter.

Further, a respective connection device between the respective end carriage 10 and the respective traveling gear group 11 comprises two connecting rods 29, 30 which are arranged at both sides of the central joint 22 viewed in direction at a right angle to the rail 1. Each of the two connecting rods 29, 30 is connected in an articulated manner with the end carriage 10 and with the rocker 19. These joints 31, 32 of the connecting rods 29, 30, which lie one above the other, are constructed in such a way that compressive forces and tensile forces can be transmitted between the respective end carriage 10 and the respective traveling gear group 11 by the connecting rods 29, 30. These joints 31, 32 have at least the following degrees of freedom: a degree of freedom for swiveling the respective connecting rod 29, 30 relative to the end carriage 10 and also relative to the rocker 19 around an axis 33 extending at right angles to the respective rail 1 and a degree of freedom for swiveling the respective connecting rod 29, 30 relative to the end carriage 10 and relative to the traveling gear group 11 around a horizontal axis 34 extending parallel to the respective rail 1, In the present embodiment example, the joints 31, 32 are constructed as spherical joints or ball joints. A bearing pin 35 is connected to the end carriage 10 and the rocker 19, respectively. An inner race 36 with a spherical or spherical-segment-shaped outer surface is arranged on the bearing pin 35. An outer race 37 with a spherical or spherical-segment-shaped inner surface that cooperates with the spherical outer surface of the inner race 36 is arranged in a respective bore hole of the connecting rod 29, 30.

Therefore, all occurring vertical forces are transmitted by the connecting rods 29, 30. These vertical forces result from the weight of the crane construction on one hand and from tilting moments on the other hand producing tensile forces paired with compressive forces. Horizontal forces are not transmitted by the connecting rods 29, 30 but, as was already mentioned, are transmitted by the central joint 22.

In a neutral or zero position of a respective traveling gear group 11 with respect to a rotation around the vertical axis 23, as is shown in the drawings, the two joints 31, 32 of a respective connecting rod 29, 30 lie exactly vertically one above the other. The connecting rods 29, 30 are preferably straight and their longitudinal axes are oriented in vertical direction in the zero position. A certain inclined position of the connecting rods 29, 30 is brought about by a rotation around the vertical axis 23 proceeding from this zero position. Accordingly, the joints 31, 32 of a respective connecting rod 29, 30 no longer lie exactly vertically one above the other. However, the required angle of rotation around the vertical axis 23 and therefore the deviations from the vertical orientation of the joints 31, 32 are very small. In typical applications, the straight connecting lines between the joints 31, 32 lying one above the other are inclined by less than 5°, preferably less than 3°, relative to the vertical in all of the angular positions of the occurring angular area of the rotation around the vertical axis 23. In practice, this angle is normally less than 1°.

Further, when deviating from the zero position, a force component acting around the vertical axis 2 occurs due to the weight of the crane, and this force component increases as the deviation from the zero position increases and is transmitted to the rails 1 by the wheels 12.

Further, when deviating from the zero position, there is a reduction in vertical play in the central joint 22 depending on the angle of rotation around the vertical axis 23. The vertical play in the central joint is large enough that it persists up to the maximum angle of rotation around the vertical axis 23.

When the traveling gear group 11 swivels around the horizontal axis 24 of the central joint 22, the connecting rods 29, 30 swivel around the horizontal axes 33 of the joints 31, 32. The horizontal axes 33 of the joints 31, 32 lie parallel to the horizontal axis 24 of the central joint 22.

The respective traveling gear group 11 can be rotatable relative to the respective end carriage 10 around the vertical axis 23 by at least 1°, for example.

The respective traveling gear group 11 can be swivelable relative to the respective end carriage 10 around the horizontal axis 24 of the central joint 22 extending at right angles to the rail 1 by at least 5°, for example.

A respective connecting rod 29, 30 can be swivelable relative to the respective rocker 19 around the horizontal axis 34 of the joint 32 extending at right angles to the rail 1 by at least 3°, for example.

A respective connecting rod 29, 30 can be swivelable relative to the respective rocker 19 around the horizontal axis 34 of the joint 32 extending parallel to the rail 1 by at least 1°, for example.

A respective connecting rod 29, 30 can be swivelable relative to the respective end carriage 10 around the horizontal axis 33 of the joint 31 extending at right angles to the rail 1 by at least 3°, for example.

A respective connecting rod 29, 30 can be swivelable relative to the respective end carriage 10 around the horizontal axis 34 of the joint 31 extending parallel to the rail 1 by at least 1°, for example.

A traveling gear group according to the invention can also have more or less than eight wheels 12 which are spaced apart in the movement direction. At least two wheels which are rotatably mounted at a common subframe 16 so as to be spaced apart from one another in longitudinal direction of the respective rail are provided.

When the traveling gear group is constructed with only one subframe, the central joint 22 can be arranged directly between this subframe and the end carriage, and the lower joint 32 of the connecting rods 29, 30 can likewise be arranged directly at the subframe.

For example, in a traveling gear with four wheels 12 arranged one behind the other in the traveling direction, two wheels can be rotatably mounted at a respective subframe and the subframe can be connected to a rocker 17 in the manner described above. In this case, the central joint 22 could be arranged directly between the end carriage 10 and this rocker, and the lower joints 32 of the connecting rods 29, 30 could be arranged directly between the connecting rods 29, 30 and this rocker.

Figure 7:
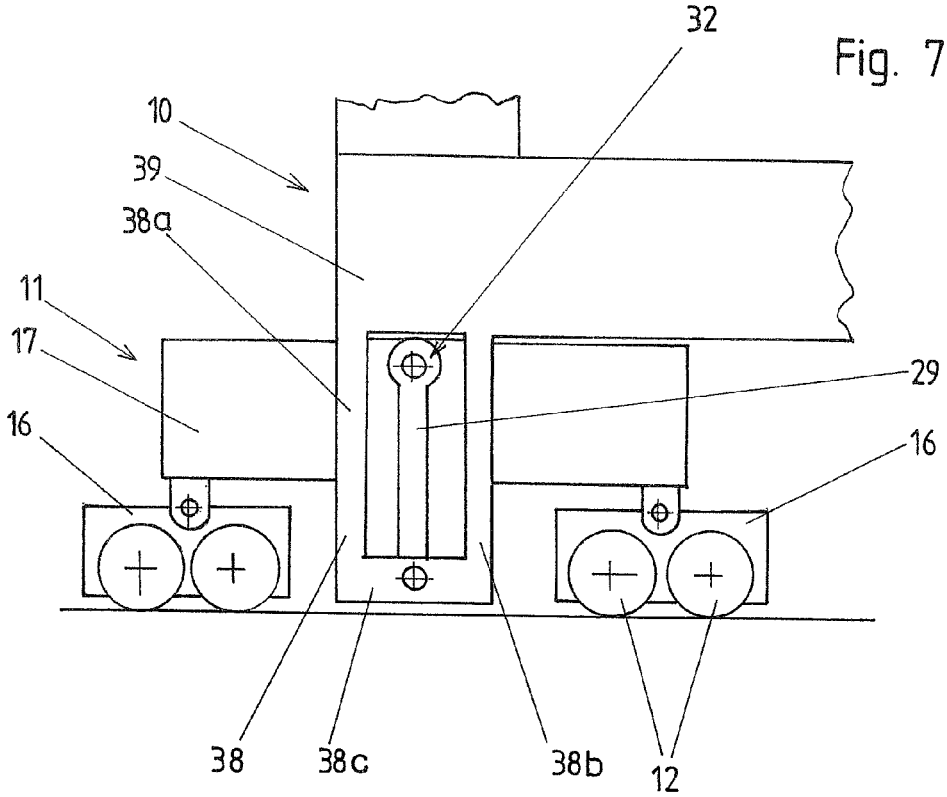
FIG. 7 is a schematic side view of another embodiment form of the invention.
Figure 8:
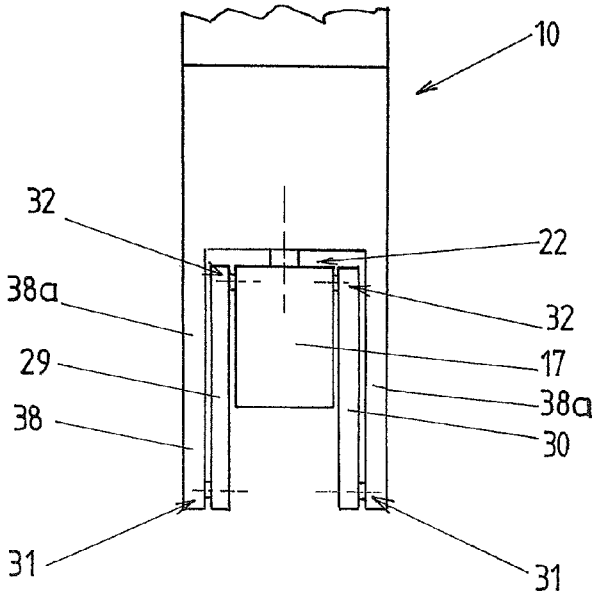
FIG. 8 is a schematic front view of the embodiment form from FIG. 7 (parts of the traveling gear are omitted for the sake of clarity).

Another embodiment form of the invention is shown schematically in FIGS. 7 and 8. It will be explained in the following how this embodiment form differs from the embodiment form described above. For the rest, the construction is identical to or similar to that described above.

In contrast to the embodiment example shown in FIGS. 1 to 6, which shows an "standing" bearing support of the end carriage 10 on the traveling gear group 11, the present embodiment form according to FIGS. 7 and 8 is a "suspended" bearing support, i.e., in the embodiment example according to FIGS. 1 to 6, the connecting rods 29, 30 are only loaded compressively at least without external forces acting on the crane and in the middle position of the hoisting device of the crane, whereas the loading is tensile in the embodiment example according to FIGS. 7 and 8. In this case, for a respective connecting rod 29, 30, the joint 31 by which the articulation at the end carriage 10 is carried out lies below the joint 32 by which the articulation at the traveling gear group 11 is carried out (whereas in the embodiment example according to FIGS. 1 to 6 the joints 31 for connecting to the end carriage 10 lie above the joints 32 for connecting to the traveling gear group 11).

The end carriage 10 has downwardly projecting connection portions 38 for articulating the connecting rods 29, 30 at the end carriage 10. A connection portion 38 of this kind extends downward on both sides of a portion of the traveling gear group 11, in this case, the rocker 17. The connection portions 38 each carry a joint 31 for articulating the respective connecting rod 29, 30.

The connection portions 38 can be U-shaped, for example, as is shown, and have two vertical sides 38*a*, 38*b* which are spaced apart in longitudinal direction of the rail 1 and which proceed from an opposite portion 39 of the end carriage 10 and are connected to one another at their lower ends by a horizontal web 38*c*. The joint 31 is arranged at this web 38*c*. Other constructions of the connection portions 38 can also be provided. For example, they can also be constructed in a continuous plate shape.

FIGS. 7 and 8 show the traveling gear group 11 with four wheels 12 which are spaced apart from one another in the traveling direction. Two wheels 12 in each instance are rotatably supported at a common subframe 16 and the two subframes 16 are connected to a rocker 17 in an articulated manner (similar to the embodiment example described above). A construction with eight wheels could also be provided, for example, as is shown in the embodiment example in FIGS. 1 to 6. A different quantity of wheels 12 could also be provided, at least two wheels 12 again being rotatably mounted at a common subframe 16 so as to be spaced apart from one another in the traveling direction.

The description of the embodiment example shown in FIGS. 1 to 6 with respect to the joints 31, 32 and central joint 22, particularly with regard to the degrees of freedom and possible angles of rotation of these joints, also applies to the present embodiment example.

For example, the traveling gear groups of a bridge crane could be connected to an end carriage of the steel construction of the crane in the manner according to the invention.

As follows from the preceding description, the range of the invention is not limited to the embodiment examples shown herein, but rather should be defined with reference to the appended claims together with their full range of possible equivalents. While the preceding description and drawings show the invention, it is obvious to a person skilled in the art that various modifications can be carried out without departing from the spirit of and field of the invention.

REFERENCE NUMBERS

1 rail
2 leg
3 leg
4 leg
5 leg
6 transverse girder
7 transverse girder
8 trolley
9 connection girder
10 end carriage
11 traveling gear group
12 wheel
13 axle
14 flange
15 flange
16 subframe
17 rocker
18 axis
19 rocker
20 axis
21 driving motor
22 central joint
23 vertical axis
24 horizontal axis
25 bearing pin
26 bearing bush
27 inner race
28 outer race
29 connecting rod
30 connecting rod
31 joint
32 joint
33 horizontal axis
34 horizontal axis
35 bearing pin
36 inner race
37 outer race
38 connection portion
38*a* side
38*b* side
38*c* web
39 portion

What is claimed is:

1. A crane comprising:

a traveling gear which comprises a plurality of traveling gear groups for moving the crane along rails;

each traveling gear group having at least two wheels which are rotatably mounted at a subframe so as to be spaced apart in longitudinal direction of the respective rail;

at least one end carriage;

a respective traveling gear group being connected to a respective end carriage by a central joint having at least degrees of freedom for rotating the traveling gear group relative to the end carriage around a vertical axis and for swiveling the traveling gear group relative to the end carriage around a horizontal axis extending at right angles to the rails and being constructed in vertical direction as a floating bearing so that only horizontal forces can be transmitted by said central joint;

a respective traveling gear group being further connected to a respective end carriage by two connecting rods which are arranged on opposite sides of the central joint viewed in transverse direction of the respective rail and which are connected to the traveling gear group on one side and to the end carriage on the other side by joints lying one above the other; and said joints capable of transmitting compressive forces as well as tensile forces and which have at least degrees of freedom for swiveling the connecting rods relative to the traveling gear group and relative to the end carriage, respectively, around a horizontal axis extending at right angles to the respective rail and around a horizontal axis extending parallel to the respective rail.

2. The crane according to claim 1, wherein said central joint is constructed as a spherical joint.

3. The crane according to claim 1, wherein the two joints of a respective connecting rod lie vertically one above the other in a zero position of the swiveling of the central joint around the vertical axis.

4. The crane according to claim 1, wherein the two joints of a respective connecting rod have a deviation of less than 5° in all positions of the swiveling of the central joint around the vertical axis relative to a position vertically one above the other.

5. The crane according to claim 1, wherein the two joints of a respective connecting rod have a deviation of less than 3° in all positions of the swiveling of the central joint around the vertical axis relative to a position vertically one above the other.

6. The crane according to claim 1, wherein the connecting rods are constructed so as to be straight.

7. The crane according to claim 1, wherein the joints by which the connecting rods are connected to the respective traveling gear group and the respective end carriage are constructed as spherical joints.

8. The crane according to claim 1, wherein the connecting rods are articulated by their lower joints to a rocker which is supported by subframes directly or by at least one other rocker.

9. The crane according to claim 1, wherein the connecting rods are articulated at the respective subframe by their lower joints.

* * * * *